US006734779B2

(12) United States Patent
Yu

(10) Patent No.: US 6,734,779 B2
(45) Date of Patent: May 11, 2004

(54) SWITCH STRUCTURE WITH OVERLOAD PROTECTION

(76) Inventor: Tsung-Mou Yu, No. 4, Alley 2, Lane 23, Sec. 3, Pa Te Rd., Panchiao City, Taipei Hsien (TW)

( * ) Notice: Subject to any disclaimer, the term of this patent is extended or adjusted under 35 U.S.C. 154(b) by 0 days.

(21) Appl. No.: 10/228,341

(22) Filed: Aug. 24, 2002

(65) Prior Publication Data

US 2004/0036570 A1 Feb. 26, 2004

(51) Int. Cl.[7] ..... H01H 37/52; H01H 37/02
(52) U.S. Cl. ..... 337/59; 337/56; 337/91
(58) Field of Search ..... 337/59, 56, 60, 337/68, 79, 91; 200/622

(56) References Cited

U.S. PATENT DOCUMENTS 3,435,169 A * 3/1969 Bienwald et al. ..... 200/315
3,735,077 A * 5/1973 Ohashi ..... 200/315
4,013,857 A * 3/1977 Tanaka
4,115,673 A * 9/1978 Smith ..... 200/315
4,337,450 A * 6/1982 Matthies ..... 337/66
4,345,233 A * 8/1982 Matthies ..... 337/75
4,736,081 A * 4/1988 Sorrells ..... 200/525
4,904,833 A * 2/1990 Sato et al. ..... 200/557
5,453,725 A * 9/1995 You et al. ..... 337/68
5,541,569 A * 7/1996 Jang ..... 337/68
6,252,490 B1 * 6/2001 Lin ..... 337/79
6,275,134 B1 * 8/2001 Chen ..... 337/37
6,570,480 B1 * 5/2003 Huang

* cited by examiner

*Primary Examiner*—Anatoly Vortman

(57) ABSTRACT

A switch includes a casing having a bottom to which first and second conductive blades are mounted. The second blade has a top edge forming a notch for receiving a see saw plat and allowing seesawing of the seesaw plate. A conductive strip made of a material that bends when subject to a temperature rise has an end fixed to the first blade and an opposite, free end forming a cantilever. The seesaw plate is movable between an engaged position where a first end of the seesaw plate engages the free end of the conductive strip thereby forming an electrical connection between the first and second blades and a disengaged position where the seesaw plate disengages from the conductive strip thereby electrically disconnecting the second blade from the first blade. A control button is movably received in a top opening of the casing and has a driver assembly mounted thereto. The control button is movable between a first position wherein the driver assembly drives the seesaw plate toward the engaged position and a second position where the driver assembly drives the seesaw plate toward the disengaged position. When an excessive current flows through the conductive strip, causing a temperature rise in the conductive strip, the conductive strip bends and separates the free end thereof from the seesaw plate thereby breaking the electrical connection between the first and second blades.

13 Claims, 8 Drawing Sheets

SWITCH STRUCTURE WITH OVERLOAD PROTECTION

FIELD OF THE INVENTION

The present invention relates generally to a switch, and in particular to a switch having an overload protection mechanism for operation safety.

BACKGROUND OF THE INVENTION

A switch is operable between an ON (connected) state and an OFF (disconnected) state for control of power supply or electrical signal transmission. For a power switch, overheating and burning caused by overload resulting from undesired shorting is one of the major concerns of operation safety. Some switches available in the market are provided with safety mechanism that automatically cuts off power supplied therethrough in order to eliminate the potential risk of overheating and burning. Such switches, however, have complicated structures, making costs high and manufacture difficult.

It is thus desirable to have a switch structure that is simple in structure but possesses operation safety feature.

SUMMARY OF THE INVENTION

An object of the present invention is to provide a switch having a simple structure while capable of operation safety.

Another object of the present invention is to provide a switch of low costs while having overload protection.

A further object of the present invention is to provide a switch which is easy to manufacture.

To achieve the above objects, in accordance with the present invention, there is provided a switch comprising a casing having a bottom to which first and second conductive blades are mounted. The second blade has a top edge forming a notch for receiving a seesaw plate and allowing seesawing of the seesaw plate. A conductive strip made of a material that bends when subject to a temperature rise has an end fixed to the first blade and an opposite, free end forming a cantilever. The seesaw plate is movable between an engaged position where a first end of the seesaw plate engages the free end of the conductive strip thereby forming an electrical connection between the first and second blades and a disengaged position where the seesaw plate disengages from the conductive strip thereby electrically disconnecting the second blade from the first blade. A control button is movably received in a top opening of the casing and has a driver assembly mounted thereto. The control button is movable between a first position wherein the driver assembly drives the seesaw plate toward the engaged position and a second position where the driver assembly drives the seesaw plate toward the disengaged position. When an excessive current flows through the conductive strip, causing a temperature rise in the conductive strip, the conductive strip bends and separates the free end thereof from the seesaw plate thereby breaking the electrical connection between the first and second blades.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE INVENTION

Figure 1:
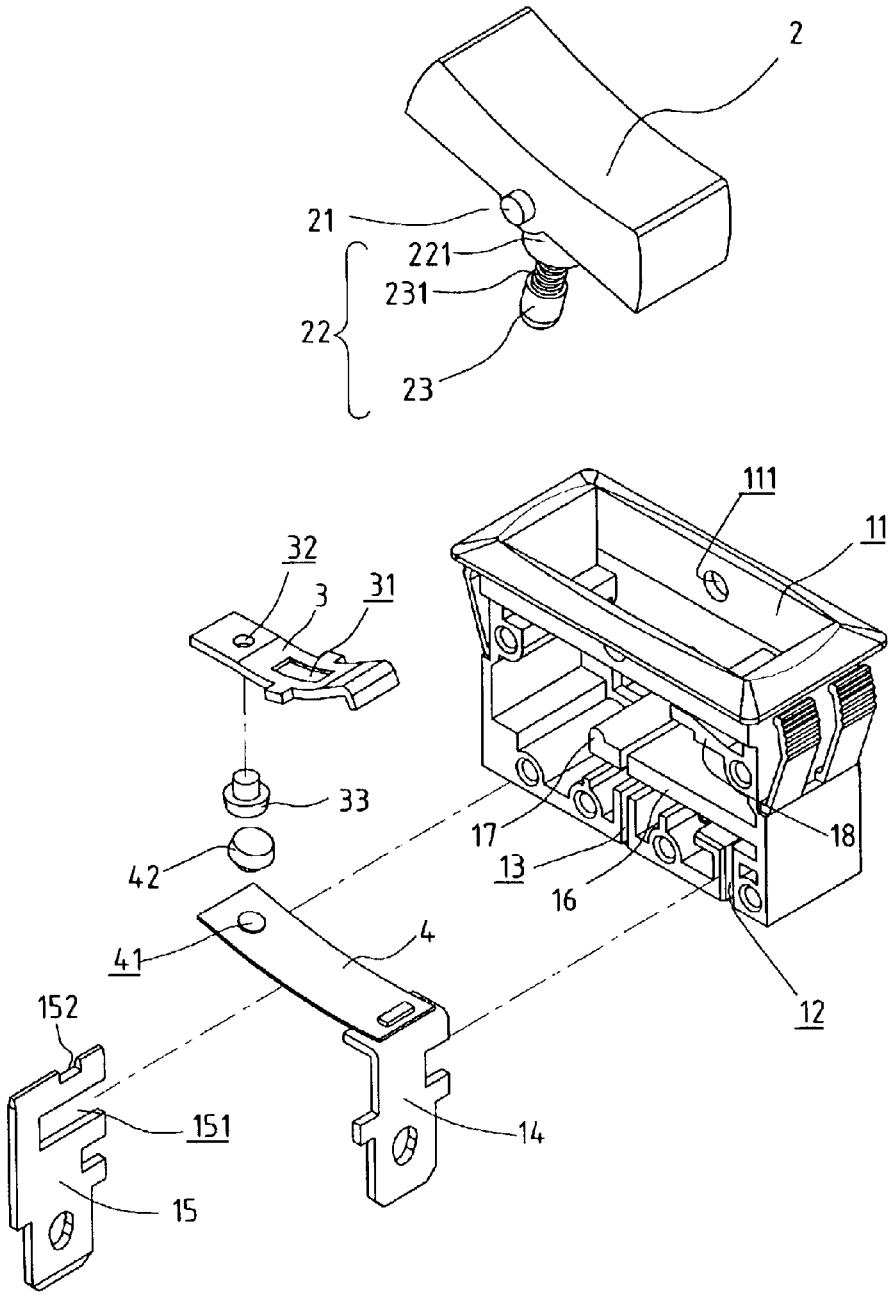
FIG. 1 is an exploded perspective view of a switch constructed in accordance with a first embodiment of the present invention.
Figure 2:
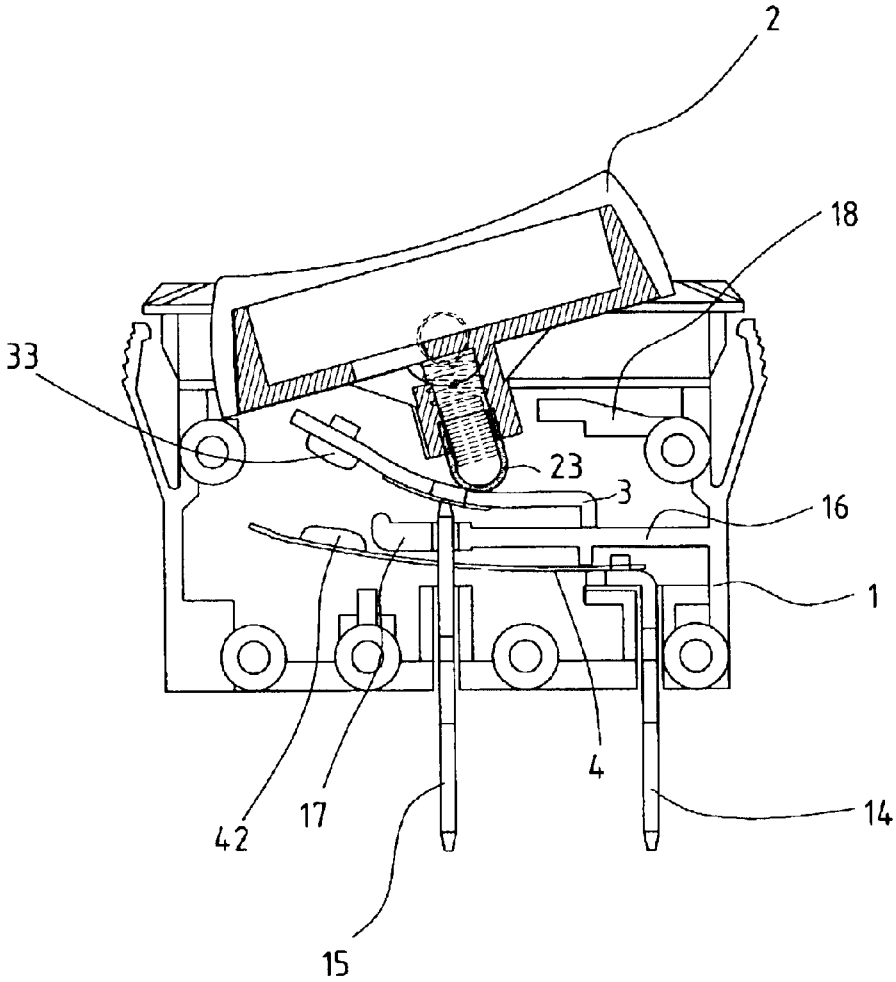
FIG. 2 is a cross-sectional view of the switch in an OFF condition.
Figure 3:
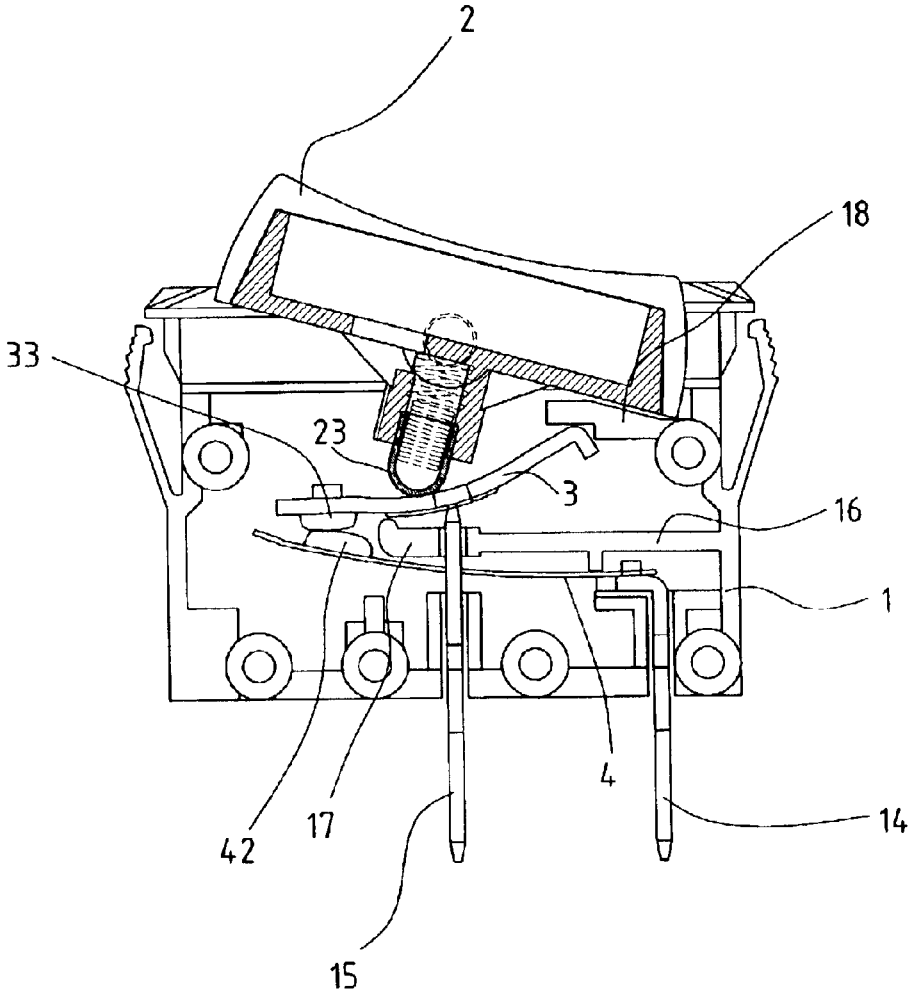
FIG. 3 is a cross-sectional view of the switch in an ON condition.

With reference to the drawings and in particular to FIGS. 1–3, a switch constructed in accordance with the present invention comprises a casing 1 forming an interior space (not labeled) and having opposite side walls (not labeled) defining a top opening 11 in communication with the interior space. Aligned holes 111 arc defined in the sidewalls. A rotation button 2 is partially received in the opening 11 and has opposite pivot pins 21 rotatably received in the holes 111 of the casing 1 whereby the button 2 is rotatable between first and second positions respectively associated with ON and OFF conditions of the switch as shown in FIGS. 3 and 2.

A driver assembly 22 is formed on an underside of the button 2 and extends into the interior space of the casing 1. The driver assembly 22 comprises a cylinder 221 extending from the underside of the button 2 inside which a cap 23 is partially and movably received. A biasing element 231, such as a helical spring, is mounted between the cylinder 221 and the cap 23 for biasing the cap 23 away from the cylinder 221. The helical spring 231 is received and retained in both the cylinder 221 and the cap 23.

Two slots 12, 13 are defined in a bottom (not labeled) of the casing 1. First and second conductive blades 14, 15 are fit and fixed in the slots 12, 13 and having tails (not labeled) extending beyond the bottom of the casing 1 for external connection. An opening 151 is defined in the second blade 15. A conductive strip 4 made of a conductive material, such as an alloy or a bimetal, that bends when subject to heat and thus having a temperature rise is arranged inside the casing 1 and has an end attached to the first blade 14 and a second, free end extending through the opening 151, forming a cantilever beam. The opening 151 is large enough to accommodate the bending and deformation of the conductive strip 4 without any physical engagement therebetween.

The second blade 15 defines a notch 152 in a top edge (not labeled) thereof. A seesaw plate 3 made of a conductive material is arranged inside the casing 1 and has a concave configuration and forms a bottom projection (not labeled) fit in the notch 152 of the second blade 15 whereby the seesaw plate 3 seesaws about the top edge of the second blade 15. The bottom projection of the seesaw plate 3 is formed by pressing the plate 3 which forms a recess 31 on a top side thereof and the recessed portion of the plate 3 forms the projection. A hole 32 is defined at a first end of the seesaw plate 3 to which a first contact 33 is received and fixed. A second contact 42 is mounted to a hole 41 defined in the conductive strip 4 to correspond to the first contact 33.

The cap 23 of the button 2 engages the top side of the seesaw plate 3 and is slidable along the seesaw plate 3 to seesaw the seesaw plate 3. When the button 2 is rotated to the first position (the ON condition, FIG. 3), the cap 23 is moved to the first end of the seesaw plate 3 close to the first contact 33 whereby the seesaw plate 3 is moved to an engaged position where the first contact 33 is brought into engagement with the second contact 42 of the conductive strip 4. Thus, an electrical connection between the first and second blades 14, 15, through the conductive strip 4, the second and first contacts 42, 33 and the seesaw plate 3, is formed.

When the button 2 is rotated to the second position (the OFF condition, FIG. 2), the cap 23 is moved to a second end of the seesaw plate 3 away from the first contact 33 whereby the seesaw plate 3 is moved to a disengaged position by rotation about the notch 152 of the second blade 15 to separate the first contact 33 from the second contact 42. Thus, the electrical connection between the first and second blades 14, 15 is broken.

In sliding along the seesaw plate 3 between the first and second ends thereof, the cap 23 is forced toward the button 2 when the cap 23 passes the edge of the second blade 15 by deforming the biasing element 231. If desired, the cap 23 may be partially received in the recess 31 defined in the top side of the seesaw plate 3 to be guided thereby.

The rotation of the button 2 between OFF and ON conditions causes the seesaw plate 3 to seesaw between the disengaged and engaged positions. When the seesaw plate 3 is moved to the disengaged position, to ensure correctly positioning of the seesaw plate 3 and to prevent undesired engagement between the seesaw plate 3 and the first blade 14 (noting that the seesaw plate 3 is always in engagement with the second blade 15), a partition 16 is formed inside the casing 1 and extending above the conductive strip 4 and the first blade 14. Thus, when the seesaw plate 3 is moved to the disengaged position, the second end of the seesaw plate 3 is stopped by the partition 16 thereby ensuring the correct positioning of the seesaw plate 3 at the disengaged position.

Similarly, when the seesaw plate 3 is moved to the engaged position, the casing 1 forms a first stop 17 located between the first end of the seesaw plate 3 and the conductive strip 4. When the first contact 33 engages the second contact 42, the first stop 17 engages the seesaw plate 3 and thus fixing the seesaw plate 3 at the engaged position. Overturning of the seesaw plate 3 is prevented. An additional second stop 18 may be formed inside the casing 1 spaced from and substantially opposite to the partition 16 for engaging the second end of the seesaw plate 3 and thus further fixing the seesaw plate 3 at the engaged position.

Figure 4:
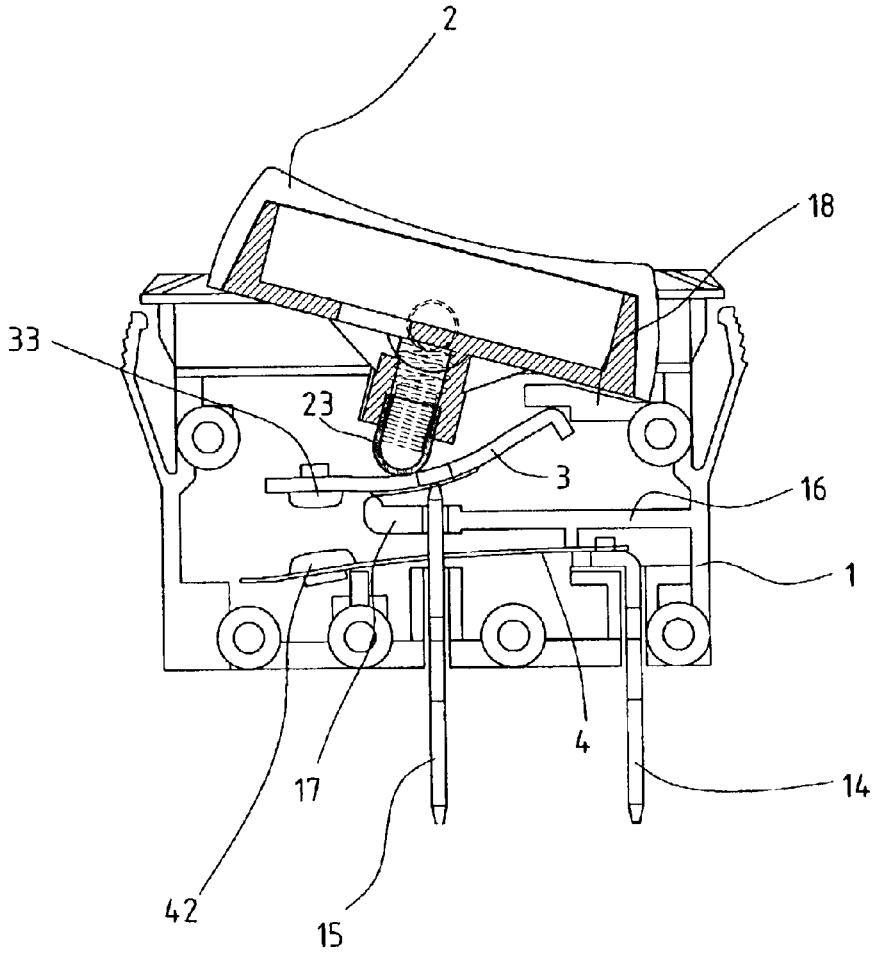
FIG. 4 is a cross-sectional view of the switch in a breaking condition.

Also referring to FIG. 4, when an overload happens, an excessive current flows through the conductive strip 4, causing a significant temperature rise. The conducive strip 4 thus bends in a direction away from the seesaw plate 3 to separate the first and second contacts 33, 42 thereby breaking the electrical connection between the first and second blades 14, 15 and cutting off the current. The stop 17 that is located between the seesaw plate 3 and the conductive strip 4 also functions to prevent the conductive strip 4 from bending toward the seesaw plate 3. Thus, the conductive strip 4 is only allowed to bend, due to temperature rise, in a direction away from the seesaw plate 3 in order to properly disengage the contacts 33, 42.

Preferably, one or more stops are formed inside the casing for preventing over-bending of the conductive strip 4 when the conductive strip 4 is subject to a temperature rise. This is to ensure that the conductive strip 4 does not contact the second blade 15 even when it is subject to a significant temperature rise.

To return to the normal operation from the breaking condition, the button 2 is moved to the OFF condition. The conductive strip 4 restores its original position when the temperature thereof lowers down. The button 2 may then be moved to the ON condition to engage the first contact 33 with the second contact 42 for resuming electrical connection between the first and second blades 14, 15.

Figure 5:
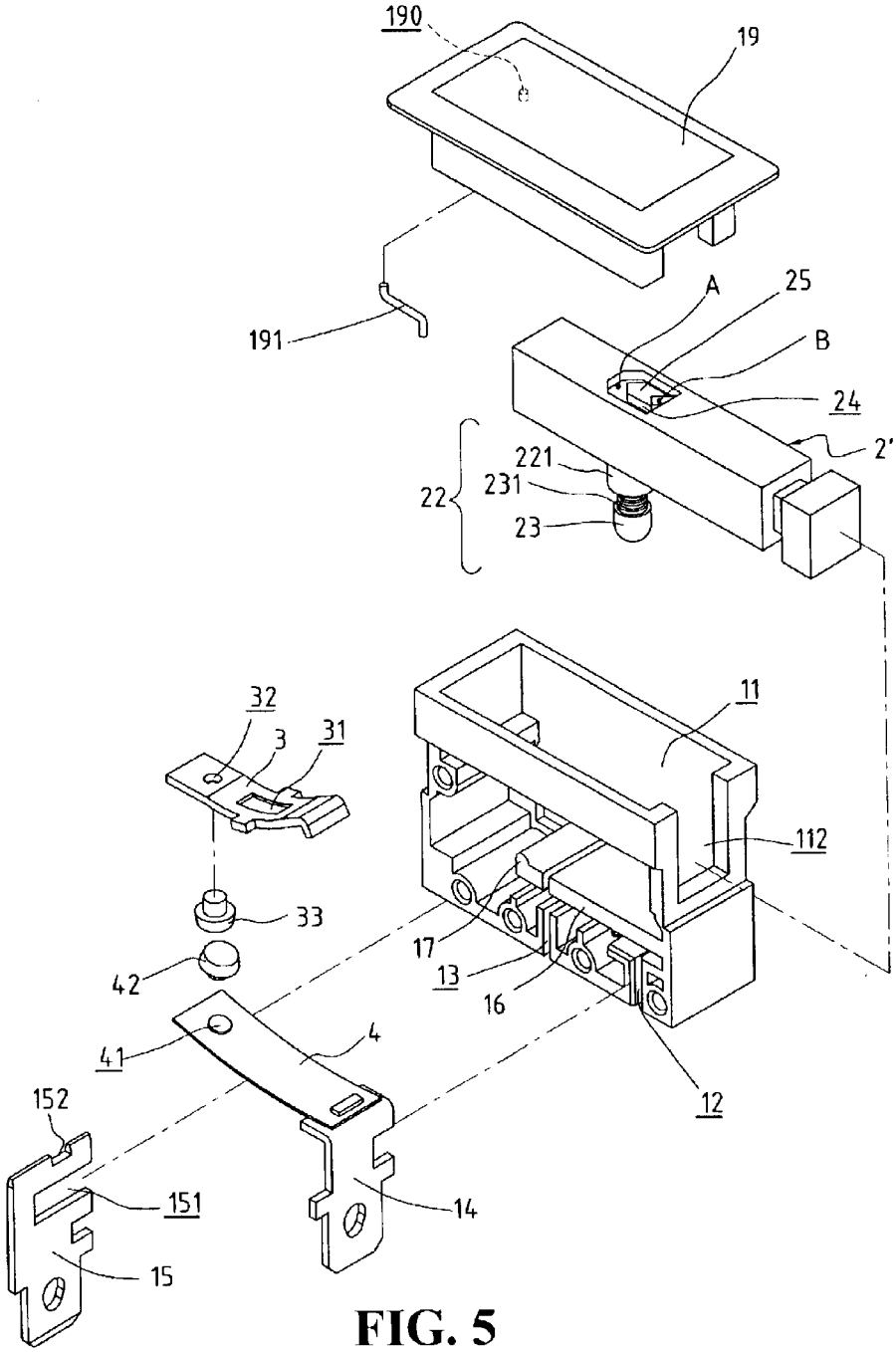
FIG. 5 is an exploded view of a switch constructed in accordance with a second embodiment of the present invention.
Figure 6:
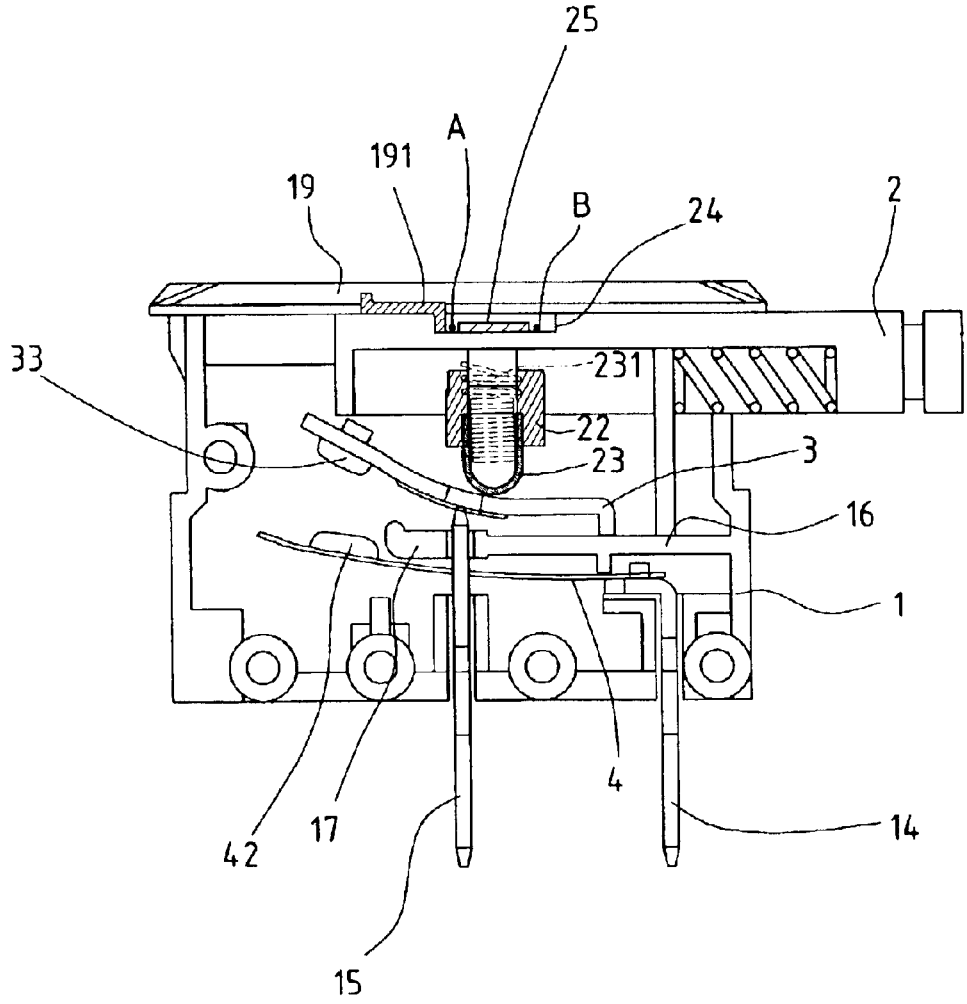
FIG. 6 is a cross-sectional view of the switch in an OFF condition.
Figure 7:
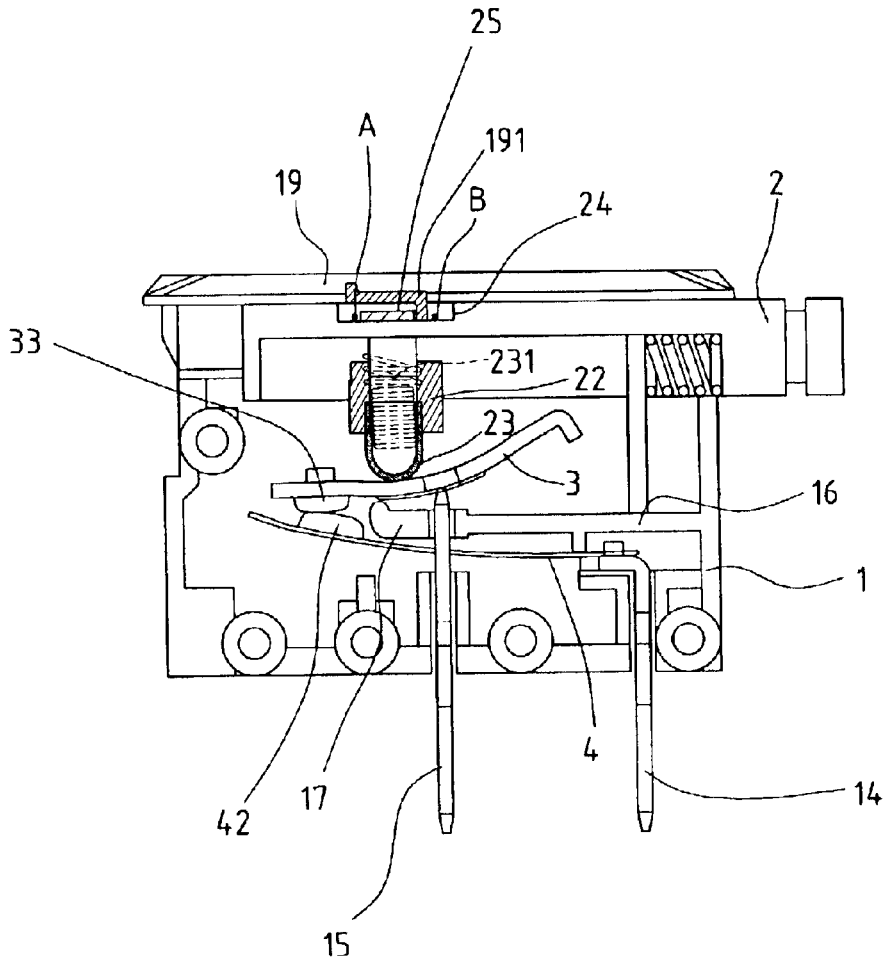
FIG. 7 is a cross-sectional view of the switch in an ON condition.

FIGS. 5–7 show a switch constructed in accordance with a second embodiment of the present invention, comprising a casing 1 forming an interior space (not labeled) and having opposite side walls (not labeled) defining a top opening 11 and a side opening 112 both in communication with the interior space. A cover 19 is fit into the top opening 11 and is fixed to the casing 1. A hole 190 is defined in an inside surface (not labeled) of the cover 19. A Z-shaped bar 191 has a major central section and two minor end sections extending from opposite ends of the central section in opposite directions. An end section of the bar 191 is fit into the hole 190 whereby the bar 191 is attached to the inner surface of the cover 19.

A push button 2' is movably received in the interior space of the casing 1 through the side opening 112. A guide block 25 having a polygonal configuration is formed on a top side of the pushbutton 2' defining a multi-section channel 24 surrounding the block 25. The channel 24 forms a closed loop path or route having stop points A and B. The second end section of the bar 191 is movably received in the channel 24 and is guided to move along the route. The pushbutton 2' is linearly movable with respect to the casing 1 between an outer position (FIG. 6) and an inner position FIG. 7. By repeatedly pushing the pushbutton 2', the end section of the bar 191 is moved along the channel 24 between the stop points A and B. When the pushbutton 2' is pushed once and moved to the inner position, the end section of the bar 191 is moved to the stop point B and trapped there for retaining the pushbutton 2' at the inner position. When the pushbutton 2' is pushed again and is thus moved to the outer position, the end section of the bar 191 is moved to the stop point A. The outer and inner positions of the pushbutton 2' respectively associated with OFF and ON conditions of the switch as shown in FIGS. 6 and 7. The pushbutton 2' is spring-biased for helping movement between the stop points A and B.

A driver assembly 22 is formed on an underside of the pushbutton 2' and extends into the interior space of the casing 1. The driver assembly 22 comprises a cylinder 221 extending from the underside of the pushbutton 2' inside which a cap 23 is movably received. A biasing element 231, such as a helical spring, is mounted between the cylinder 221 and the cap 23 for biasing the cap 23 away from the cylinder 221. The helical spring 231 is received and retained in both the cylinder 221 and the cap 23.

Two slots 12, 13 are defined in a bottom (not labeled) of the casing 1. First and second conductive plates 14, 15 are fit and fixed in the slots 12, 13 and having tails (not labeled) extending beyond the bottom of the casing 1 for external connection. An opening 151 is defined in the second blade 15. A conductive strip 4 made of a conductive material, such as an alloy and a bimetal, that bends when subject to heat and thus having a temperature rise has an end attached to the first blade 14 and a second, free end extending through the opening 151 forming a cantilever beam. The opening 151 is large enough to accommodate the deformation of the conductive strip 4 without any physical engagement therebetween.

The second blade 15 defines a notch 152 at a top edge (not labeled) thereof. A seesaw plate 3 made of a conductive material has a concave configuration and forms a bottom projection (not labeled) fit in the notch 152 of the second blade 15 whereby the seesaw plate 3 seesaws about the top edge of the second blade 15. The bottom projection of the seesaw plate 3 is formed by pressing the plate 3 which forms a recess 31 on a top side thereof and the recessed portion of the plate 3 forms the projection. A hole 32 is defined at a first end of the seesaw plate 3 to which a first contact 33 is received and fixed. A second contact 42 is mounted to a hole 41 defined in the conductive strip 4 to correspond to the first contact 33.

The cap 23 of the button 2 engages the top side of the seesaw plate 3 and is slidable along the seesaw plate 3 to seesaw the seesaw plate 3. When the pushbutton 2' is moved to the inner position (the ON condition, FIG. 7), the cap 23 is moved to the first end of the seesaw plate 3 close to the first contact 33 whereby the seesaw plate 3 is driven to an engaged position where the first contact 33 is brought into engagement with the second contact 42 of the conductive strip 4. Thus, an electrical connection between the first and second blades 14, 15, through the conductive strip 4, the second and first contacts 42, 33 and the seesaw plate 3, is formed.

When the pushbutton 2' is moved to the outer position (the OFF condition, FIG. 6). The cap 23 is moved to a second end of the seesaw plate 3 away from the first contact 33 whereby the seesaw plate 3 is driven to a disengaged position by rotation about the notch 152 of the second blade 15 to separate the first contact 33 from the second contact 42. Thus, the electrical connection between the first and second blades 14, 15 is broken.

In sliding along the seesaw plate 3 between the first and second ends thereof, the cap 23 is forced toward the button 2 when the cap 23 passes the edge of the second blade 15 by deforming the biasing element 231. If desired, the cap 23 may be partially received in the recess 31 defined in the top side of the seesaw plate 3 to be guided thereby.

The movement of the pushbutton 2' between the outer and inner positions (the OFF and ON conditions) causes the seesaw plate 3 to seesaw between the disengaged and engaged positions. When the seesaw plate 3 is moved to the disengaged position, to ensure correctly positioning of the seesaw plate 3 and to prevent undesired engagement between the seesaw plate 3 and the first blade 14 (noting that the seesaw plate 3 is always in engagement with the second blade 15), a partition 16 is formed inside the casing 1 and extending above the conductive strip 4 and the first blade 14. Thus, when the seesaw plate 3 is moved to the disengaged position, the second end of the seesaw plate 3 is stopped by the partition 16 thereby ensuring the correct positioning of the seesaw plate 3 at the disengaged position.

Similarly, when the seesaw plate 3 is moved to the engaged position, the casing 1 forms a stop 17 located between the seesaw plate 3 and the conductive strip 4. When the first contact 33 engages the second contact 42, the stop 17 engages the seesaw plate 3 and thus fixing the seesaw plate 3 at the engaged position. Overturning of the seesaw plate 3 is prevented.

Figure 8:
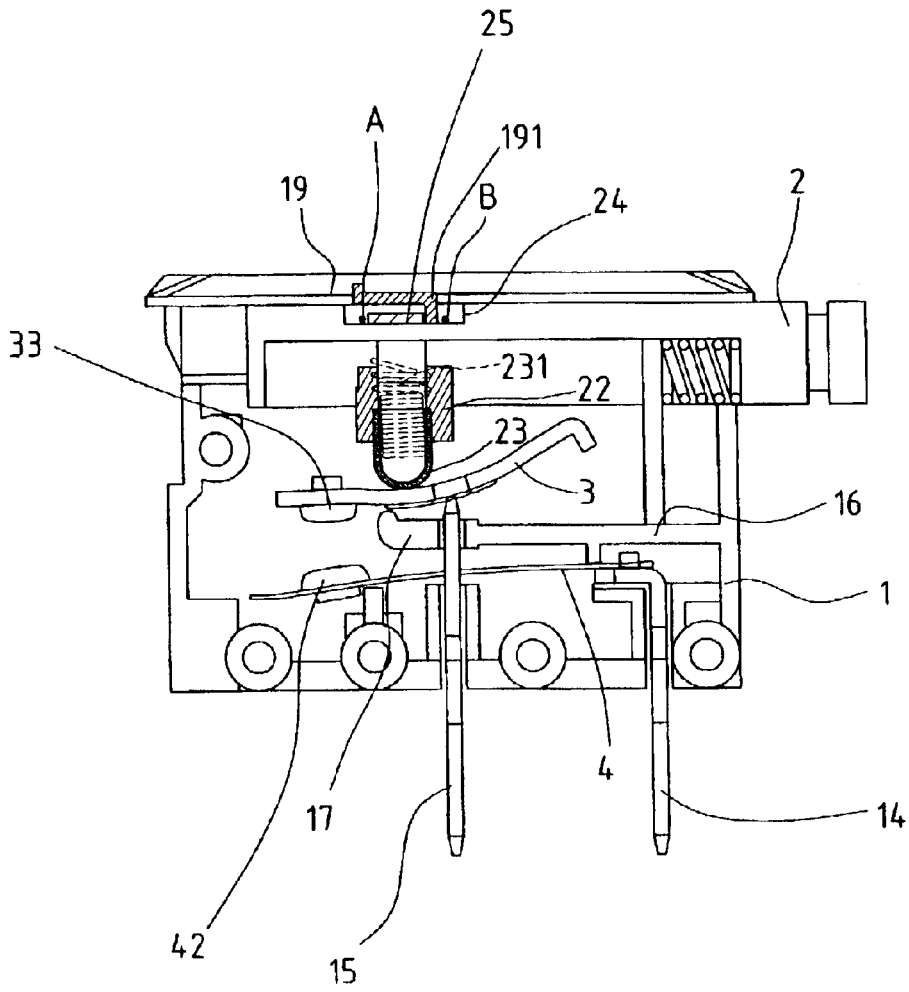
FIG. 8 is a cross-sectional view of the switch in a breaking condition.

Also referring to FIG. 8, when an overload happens, an excessive current flows through the conductive strip 4, causing a significant temperature rise. The conducive strip 4 thus bends in a direction away from the seesaw plate 3 to separate the first and second contacts 33, 42 thereby breaking the electrical connection between the first and second blades 14, 15 and cutting off the current. The stop 17 that is located between the seesaw plate 3 and the conductive strip 4 also functions to prevent the conductive strip 4 from bending toward the seesaw plate 3. Thus, the conductive strip 4 is only allowed to bend, due to temperature rise, in a direction away from the seesaw plate 3 in order to properly disengage the contacts 33, 42.

To return to the normal operation from the breaking condition, the pushbutton 2' is moved to the outer position (the OFF condition). The conductive strip 4 restores its original position when the temperature thereof lowers down. The pushbutton 2' may then be moved to the inner position (the ON condition) to engage the first contact 33 with the second contact 42 for resuming electrical connection between the first and second blades 14, 15

Although the present invention has been described with reference to the preferred embodiments thereof, it is apparent to those skilled in the art that a variety of modifications and changes may be made without departing from the scope of the is intended to be defined by the appended claims.

What is claimed is:

1. A switch comprising:

a casing defining an interior space, the casing having a bottom and a top opening in communication with the interior space;

first and second conductive blades arranged in the interior space and mounted to the bottom, the first and second blades having tails extending beyond the bottom for external connection, the second blade having a top edge forming a notch;

a conductive strip made of a material that bends when subject to a temperature rise, the strip having an end fixed to the first blade and an opposite, free end forming a cantilever;

a seesaw plate having a bottom side on which a projection is formed and an opposite top side, the projection being received in the notch of the second blade to allow seesawing of the seesaw plate about the top edge of the second blade between an engaged position where a first end of the seesaw plate engages the free end of the conductive strip thereby forming an electrical connection between the first and second blades and a disengaged position where the first end of the seesaw plate disengages from the conductive strip thereby electrically disconnecting the second blade from the first blade; and a control button movably received in the top opening of the casing and having a driver assembly mounted thereto, the control button being mounted to the casing with the driver assembly engaging the top side of the seesaw plate, the control button being movable between a first position wherein the driver assembly drives the seesaw plate toward the engaged position and a second position where the driver assembly drives the seesaw plate toward the disengaged position;

wherein with the seesaw plate engaging the conductive strip and forming the electrical connection between the first and second blades, when an excessive current flows through the conductive strip, causing a temperature rise in the conductive strip, the conductive strip bends and separates the free end thereof from the first end of the seesaw plate thereby breaking the electrical connection between the first and second blades.

2. The switch as claimed in claim 1, wherein the driver assembly comprises a cylinder formed on an underside of the control button and a movable cap partially received in the cylinder and a biasing element arranged between the cylinder and the cap for biasing the cap away from the cylinder and engaging the top side of the seesaw plate.

3. The switch as claimed in claim 2, wherein a recess is defined in the top side of the seesaw plate for partially accommodating and guiding the cap.

4. The switch as claimed in claim 2, wherein the biasing element comprises a spring.

5. The switch as claimed in claim 1, wherein a first contact is mounted to the first end of the seesaw plate and a second contact is mounted to the free end of the conductive strip, the first contact being engageable with the second contact when the seesaw plate is moved to the engaged position.

6. The switch as claimed in claim 1, wherein the casing comprises a partition which engages a second end of the seesaw plate when the seesaw plate is moved to the disengaged position for preventing engagement between the seesaw plate and the conductive strip.

7. The switch as claimed in claim 1, wherein the casing forms a stop which engages the first end of the seesaw plate when the seesaw plate is moved to the engaged position thereby properly positioning the seesaw plate at the engaged position.

8. The switch as claimed in claim 7, wherein casing forms an additional stop which engages a second end of the seesaw plate when the seesaw plate is moved to the engaged position for properly positioning the seesaw plate at the engaged position.

9. The switch as claimed in claim 1, wherein the casing forms a block located between the conductive strip and the first end of the seesaw plate for preventing the free end of the conductive strip from bending toward the seesaw plate when the conductive strip is subject to a temperature rise.

10. The switch as claimed in claim 1, wherein the control button forms pivot pins rotatably received in holes defined in side walls of the top opening of the casing for rotatably mounting the control button to the casing whereby the button is rotatable between first and second positions for moving the driver assembly along the top side of the seesaw plate.

11. A switch comprising:

a casing defining an interior space, the casing having a bottom, and top and side openings in communication with the interior space;

a cover fit to the top opening;

first and second conductive blades arranged in the interior space and mounted to the bottom, the first and second blades having tails extending beyond the bottom for external connection, the second blade having a top edge forming a notch;

a conductive strip made of a material that bends when subject to a temperature rise, the strip having an end fixed to the first blade and an opposite, free end forming a cantilever;

a seesaw plate having a bottom side on which a projection is formed and an opposite top side, the projection being received in the notch of the second blade to allow seesawing of the seesaw plate about the top edge of the second blade between an engaged position where a first end of the seesaw plate engages the free end of the conductive strip thereby forming an electrical connection between the first and second blades and a disengaged position where the first end of the seesaw plate disengaged from the conductive strip thereby electrically disconnecting the second blade from the first blade;

a control button received through the side opening of the casing and having a driver assembly mounted thereto, the control button being movably mounted to the casing with the driver assembly engaging the top side of the seesaw plate, the control button being movable between a first position wherein the driver assembly drives the seesaw plate towards the engaged position and a second position where the driver assembly drives the seesaw plate toward the disengaged position; and a control bar mounted to the cover and extending into a channel defined in a top side of the control button, the movement of the control button with respect to the casing being guided by the bar that moves along the channel between two stop points respectively corresponding to the first and second position;

wherein with the seesaw plate engaging the conductive strip and forming the electrical connection between the first and second blades, when an excessive current flows through the conductive strip, causing a temperature rise in the conductive strip, the conductive strip bends and separates the free end thereof from the first end of the seesaw plate thereby breaking the electrical connection between the first and second blades.

12. The switch as claimed in claim 11, wherein the channel forms a closed loop path for the bar whereby when the control button is actuated once, the bar moving with respect to the control button from a first stop point to a second stop point and when the control button is actuated second time, the bar moving from the second stop point back to the first stop point.

13. The switch as claimed in claim 12, wherein the control button is spring biased for returning from the second stop point back to the first stop point.

* * * * *